US008028451B1

(12) United States Patent
Lee

(10) Patent No.: US 8,028,451 B1
(45) Date of Patent: Oct. 4, 2011

(54) TAG HOLDER

(76) Inventor: Han Young Lee, Plano, TX (US)

( * ) Notice: Subject to any disclaimer, the term of this patent is extended or adjusted under 35 U.S.C. 154(b) by 32 days.

(21) Appl. No.: 11/654,420

(22) Filed: Jan. 17, 2007

(51) Int. Cl.
*G09F 3/18* (2006.01)

(52) U.S. Cl. ..... 40/642.02; 40/648; 40/661.08

(58) Field of Classification Search ..... 40/647, 40/648, 662, 661.08, 673, 27; 402/25
See application file for complete search history.

(56) References Cited

U.S. PATENT DOCUMENTS

| | | | | | |
|---|---|---|---|---|---|
| 638,171 | A | * | 11/1899 | Boville | 402/25 |
| 684,145 | A | * | 10/1901 | Watt | 402/14 |
| 793,826 | A | * | 7/1905 | Damico | 40/338 |
| 840,168 | A | * | 1/1907 | Stevenson | 40/329 |
| 1,103,031 | A | * | 7/1914 | Carter | 24/561 |
| 1,248,131 | A | * | 11/1917 | Kaplan | 248/498 |
| 1,271,607 | A | * | 7/1918 | Oppenheim | 24/703.3 |
| 1,415,713 | A | * | 5/1922 | Rosenthal | 40/662 |
| 1,477,605 | A | * | 12/1923 | Steigerwald et al. | 248/339 |
| 2,080,852 | A | * | 5/1937 | Haas | 40/302 |
| 2,127,234 | A | * | 8/1938 | Reiter | 24/703.3 |
| 2,625,723 | A | * | 1/1953 | Bassett | 24/703.3 |
| 4,389,755 | A | * | 6/1983 | Villa-Real | 24/67.9 |

* cited by examiner

*Primary Examiner* — Joanne Silbermann
*Assistant Examiner* — Christopher e Veraa
(74) *Attorney, Agent, or Firm* — Mark W Handley

(57) ABSTRACT

A tag holder (12) formed as a single stamping defines a singular body having a first tab (16), a second tab (24), and a third tab (38). The second tab (24) is cut from the first tab (16) to define an aperture (18) in the first tab for receiving a hanger rod (62) of a product display, and then the second tab (24) is folded from the first tab (16) and aligned adjacent the third tab (38). Protuberant lance portions (30) are formed from a surface (26) of the second tab (24) and extend toward the third tab (38). A hang tag (50) is placed between the second tab (24) and the third tab (38), with the aperture (18) in the first tab (16) aligned adjacent a hanger aperture (54) of the hang tag (50), and then the second tab (24) is pushed toward the third tab (38) with the protuberant lance portions (30) extending through the hang tag (50) and against the third tab (38) to secure hang tag (50) to the tag holder (12).

12 Claims, 2 Drawing Sheets

TAG HOLDER

TECHNICAL FIELD OF THE INVENTION

The present invention relates in general to hang tags used for retail sales, and in particular to a tag holder for securing a hang tag to a hanger.

BACKGROUND OF THE INVENTION

Prior hang tags have been provided for supporting various retail products, typically small items which are hung on display walls and such in retail stores. Hang tags are often formed of paper, and at times the hanger portion of hang tags will tear such that the hang tag is no longer operational or functional for hanging a product for display on a display wall. Hang tags often have to be repaired by taping, or other fastening means, or replacing the damaged hang tag with a new hang tag which requires removing the displayed product from the damaged hang tag and securing the displayed product to the new hang tag.

SUMMARY OF THE INVENTION

A tag holder is formed of a singular body having a first tab, a second tab, and a third tab. The first tab provides a hanger portion of the tag holder, and has an aperture which defines a hook member for securing to a hanger rod or hanger hook of a display. The second tab provides a latch portion of the tag holder, and is preferably defined by cutting the second tab from an interior portion of the first tab, which defines the aperture of the first tab for receiving the hanger rod of a display, and then the second tab is folded downward from within the first tab and aligned adjacent the third tab. The second tab preferably has protuberant lance portions which define protrusion which extend from a surface of the second tab toward the third tab. The third tab defines a catch portion of the tag holder which preferably has a formed surface with indentations formed therein for receiving the protuberant lance portions formed from the second tab, and bending the protuberant lance portions to extend along the indentations and back into the hang tag. A torn hanger portion of a damaged hang tag is placed between the second tab and the third tab, with the aperture in the first tab aligned adjacent the hanger aperture of the hang tag, and then the second tab portion is squeezed into the third tab to push the protrusions defined by the protuberant lance portions through a main body of the hang tag and into the indentations in the third tab, which bends the protuberant lance portions along the surface of the indentations and secures the hang tag to the tag holder. The tag holder is preferably formed as a single stamping from a single sheet of material, such as metal or other suitable materials.

DESCRIPTION OF THE DRAWINGS

For a more complete understanding of the present invention and the advantages thereof, reference is now made to the following description taken in conjunction with the accompanying Drawings in which

FIG. 1 is a front elevation view of a tag holder prior to securing the tag holder to a hang tag;

FIG. 2 is a side elevation view of the tag holder shown in FIG. 1;

FIG. 3 is a front elevation view of the tag holder after being secured to a hang tag;

FIG. 4 is a side elevation view of the tag holder shown in FIG. 3;

FIG. 5 is a front elevation view of a damaged hang tag mounted to a hanger rod of a display;

FIG. 6 is a front elevation view of the damaged hang tag of FIG. 5 after being repaired with the tag holder and then secured to the hanger rod of a display;

FIG. 7 is a section view of the repaired hang tag and tag holder, taken along section line 7-7 of FIG. 6;

FIG. 8 is an enlarged view of FIG. 7, showing the protrusions after forming to secure the tag holder to the hang tag;

FIG. 9 is a flat plan view of a singular sheet of material from which two tag holders are formed by stamping;

FIG. 10 is an end view of a second tab portion of the tag holder, showing protrusions defined by protuberant lance portions according to a preferred embodiment; and FIG. 11 is an end view of the second tab portion, having alternative protrusions formed by protuberant lance portions to have a different shape than the protrusions of FIG. 11.

DETAILED DESCRIPTION OF THE INVENTION

Figure 1:
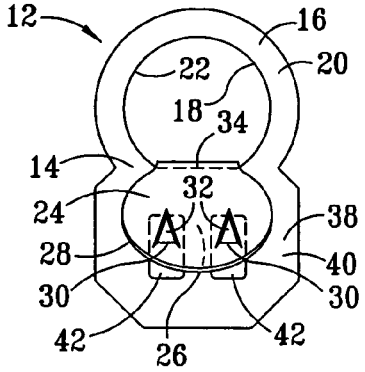
FIGS. 1 through 11 show various aspects for a tag holder made according to the present invention, as set forth below.
Figure 2:
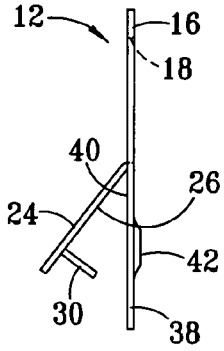

FIG. 1 is a front elevation view and FIG. 2 is a side elevation view of a tag holder 12 made according to the present invention. The tag holder 12 is preferably formed as a singular body 14 having a first tab 16, a second tab 24 and a third tab 38, which are connected together to define a singular member. The first tab 16 defines a hanger portion having an aperture 18 formed therein to define a hook member 20. The second tab 24 defines a latch portion and has a planar surface 26 with a periphery 28, and two protuberant lance portions defining protrusions 30. The protuberant lance portions 30 define holes 32, which are formed in lancing the protrusions 30 from the second tab 24. The second tab 24 is formed from the singular body member 14 by cutting into the first tab 16 defining the hanger portion, along the profile 22 to define the aperture 18. The same cut lines which define the profile 22 of the aperture 18 also preferably define the periphery 28 of the second tab 24. The second tab 24 is then folded along a connecting portion 34, which preferably defines a linear bend line along which the second tab 24 is bent downwards from within the aperture 18 of the first tab 16. The third tab 38 defines a catch portion of the tag holder 12 and has a substantially planar surface 40 in which indentations 42 are formed for receiving the protrusions 30, for bending the protrusions 30 along the surface of the indentations 42. The second tab 24 is folded along the connecting portion 34, by bending the connecting portion 24 to move the second tab 24 from within the first portion 16 to a spaced apart position, substantially adjacent to the third tab 38, with the second tab 24 disposed in spaced apart relation to the third tab 38 and the protuberances 30 spaced apart from the third tab 38.

The indentations 42 in the third tab 38 are preferably formed for receiving the protrusions 30, and bending the protrusions 30 to extend along the indentations and back into the body 52 of the hang tag 50 to retain the body 52 of the hang tag 50 between the second tab 24 and the planar surface 40 of the third tab 38, substantially flush with the second tab 24 and the third tab 38. The body 52 of the hang tag 50 will be disposed within with a small space defined between the second tab 24 and the third tab 38. The indentations 42 are shown as being rectangular shaped, with longitudinal axes of the indentations 42 extending vertically. In other embodiments, the indentations 42 may be of other shapes, and have longitudinal axes which extend at angles other than vertical, such that the longitudinal axes of the indentations 42 are disposed at a different angle to the planar surfaces of respective ones of the protuberances 30 than that shown.

Figure 3:
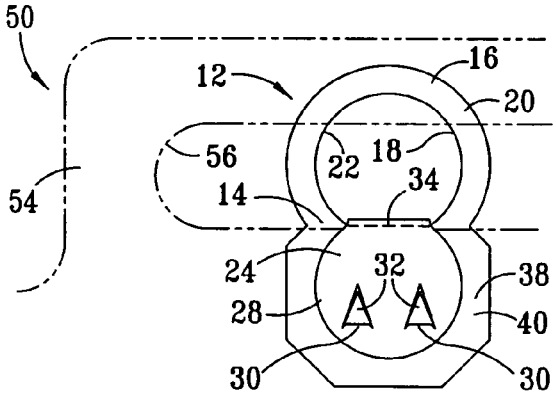
Figure 4:
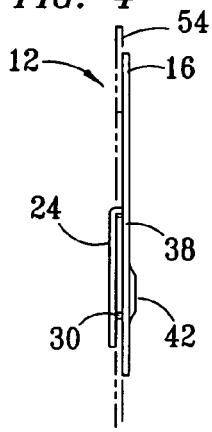

FIG. 3 is a front elevation view and FIG. 4 is a side elevation view of the tag holder 12 after the second tab 24 has been folded further toward the second tab 38 by bending the connecting portion 34, such that the second tab 24 is substantially flush against the hang tag 50, with the third third tab 38 also flush against the opposite side of the hang tag 50 from the side the second tab is disposed against. The protrusions 30 have been pressed into the third tab 38, which pushes the protrusions against the indentations 42 which forms the protrusions to bend and extend along the surface of the indentations 42 and back into the hang tag 50. Pressing the protrusions 30 against the indentations 42, the protrusions 30 bends the protrusions to be flush against the back side of hang tag 50 and flush against the indentations 42 of the third tab 38, such that the protrusions 30 lock the second tab 24 and the third tab 38 against the hang tag 50.

Figure 5:
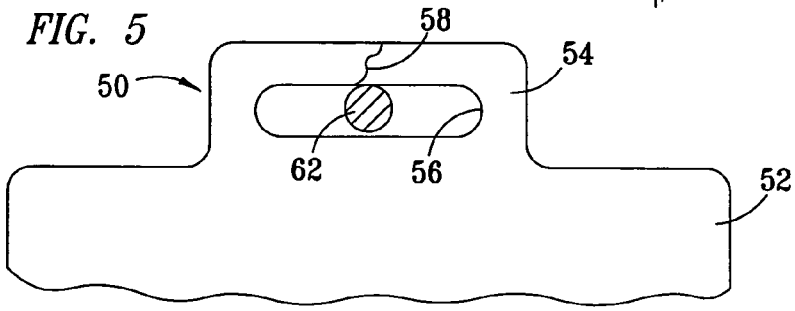

FIG. 5 is a front elevation view of the hang tag 50 mounted to a hanger rod 62 of a product display. The hang tag 50 has a main body 52 with a hanger portion 54 having a hanger aperture 56. A tear 58 is shown along an upper part of the hanger portion 54, such that the hanger aperture 56 will no longer function for securing the hang tag 50 to a hanger rod 62. The hang tag 50 is preferably the type used in retail displays, such as those in which hanger rods 62 are mounted to display walls and the hang tag 50 is used for securing products to the display walls. In other embodiments, hanger rod 62 may be a hook or other type support providing a hanger for securing the hang tag 50 to a product display.

Figure 6:
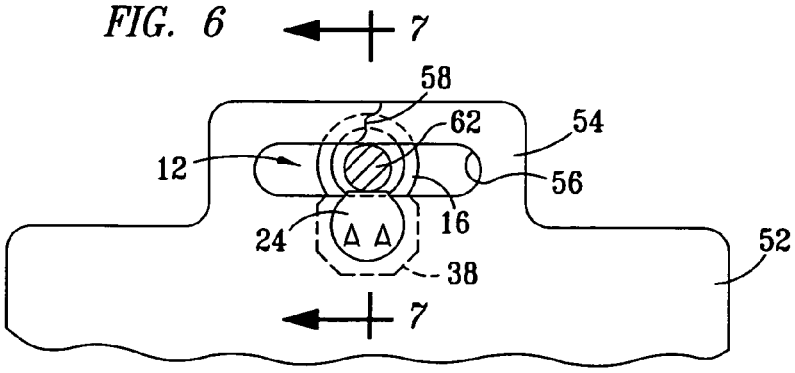

FIG. 6 is a front elevation view of the hang tag 50 secured to the hanger rod 62 of a display, with the tag holder 12 mounted to the hang tag 50 to repair the hanger portion 54. The hanger 62 is received within both the first tab 26 of the tag holder 12 and the hanger aperture 56, such that the hang tag 50 is again functional to suspend product from the hanger rod 62.

Figure 7:
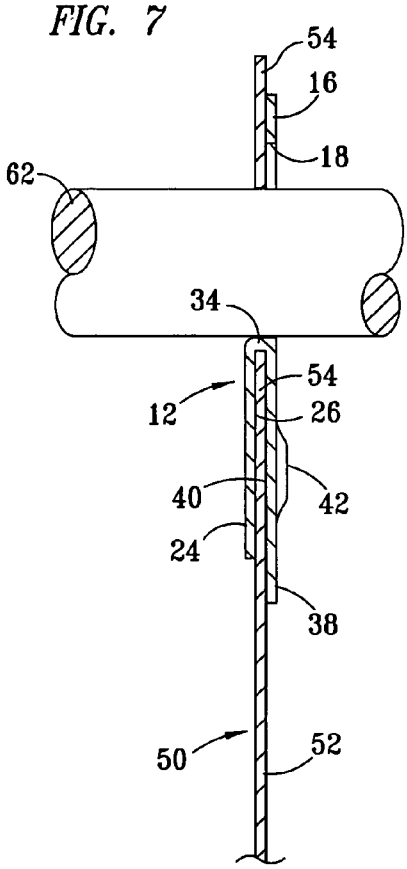
Figure 8:
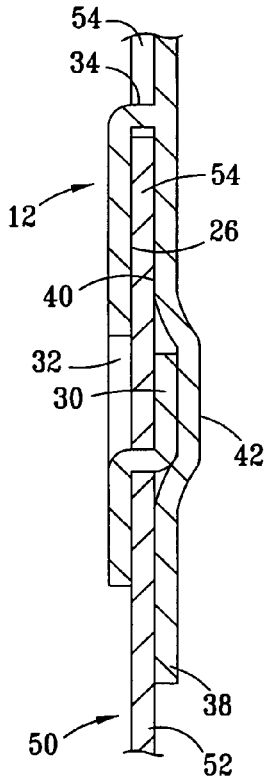

FIG. 7 is a sectional view of the hang tag 50 and the tag holder 12, taken along section line 7-7 of FIG. 6, and FIG. 8 is an enlarged view of a portion of FIG. 7 showing one of the protrusions after being formed against one of the indentations 42 of the third tab 38 to secure the tag holder 12 to the hang tag 50. The hanger portion 54 of hang tag 50 is shown secured between the planar surface 26 of the second tab 24 and the planar surface 40 of the third tab 38, with the aperture 18 of the first tab 16 in registration with the hanger aperture 56 for receiving the hanger rod 62 into the apertures 18 and 56. The protrusion 30 is shown after pressing against the indentation 42 of the third tab 38, and is extending flush against the indentation 42 in the third tab 38 and flush against the back-side of the body 54 of the hang tag 50 to secure the tag holder 12 to the hang tag 50.

Figure 9:
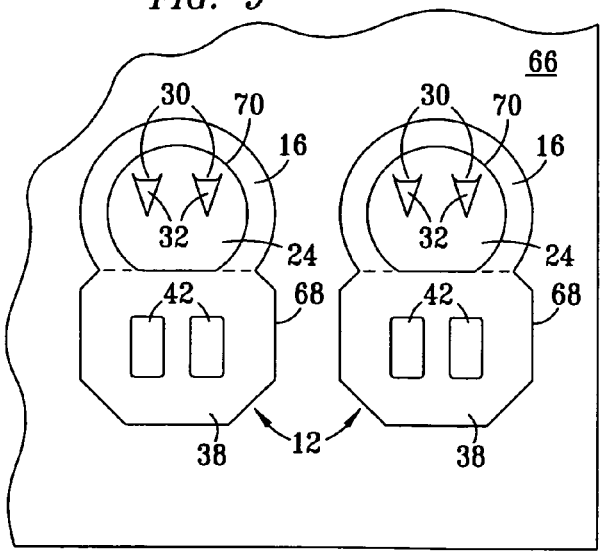

FIG. 9 is a flat plan view of two singular tag holders 12 being formed from a single sheet of material 66. It should be noted that multiple tag holders 12 will be cut from a single sheet of metal material 56, but two are shown for illustrative purposes. Cut lines 68 are shown forming the exterior peripheries of the first tab 16 and the third tab 38 of respective ones of the tag holders 12. Cut lines 70 are shown for forming the profiles 22 of the apertures 18 of the first tabs 16, and the peripheries 28 on the exterior sides of the second tabs 24 with a single cut line 70 in the tag holders 12. Preferably, the protrusions 30 will also be formed with a singular cut as protuberant lance tabs formed during stamping of the tag holders 12. The indentations 42 in the third tab 38 for receiving the protrusions 30 will also preferably be formed during the singular stamping process in which the lance tabs defining the protrusions 30 and the tabs 16, 24 and 38 are formed.

Figure 10:
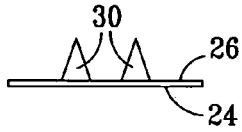

FIG. 10 is an end view of the second tab 24 of the tag holder 12, showing a profile for the protrusions 30 which is provided by the lance tabs. In the preferred embodiment, the protrusions 30 are of triangular shape having points at the terminal ends thereof.

Figure 11:
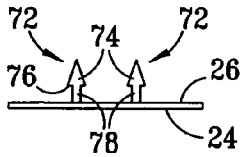

FIG. 11 is an end view a second tab portion 24 having an alternative protrusion 72 formed therefrom, rather than the protrusions 30 of the preferred embodiment. The protrusions 72 are also preferably provided by lance tabs formed from into the second tab 24 by piercing, or lancing, the sheet of material 66. The alternative protrusions 72 have terminal ends with a sharp point. The protrusions 72 have a head 74, shoulders 76 and a stem 78 which connects the head 74 to the surface 26 of the second tab 24. The stems 78 will preferably bend in response to the heads 74 being pressed into the indentations 42, and the heads 74 will preferably be pushed back into the back-side of the hang tag 50 with the shoulders 76 preferably latching the protrusions 30 within material of the hang 50.

In the preferred embodiment, the tag holder 12 is formed of a thin, malleable sheet metal. In other embodiments, other suitable materials may be used, such as plastics in which a living hinge is either molded for formed by cutting into the plastic material in stamping the tag holder to provide connecting portion 34 for folding the second tab 24 adjacent the third tab 38. It should also be noted that in other embodiments, the aperture 18 in the first tab 16 may be off center from the geometric center of the first tab 16, such that one side of the aperture 18 may be open for receiving a display hanger 62 through the open side of the aperture 18.

The present invention provides advantages of an inexpensive and easy to install tag holder for repair of hanger tags which have been torn and are no longer operational for securing product to product displays. A tag holder is formed from a singular sheet of material from which multiple tag holders may be made from single stamping of the sheet of material. The tag holder is preferably a singular member having a first tab, a second tab which is formed from the first tab and folded downward adjacent a third tab. Protrusions formed from lance portions of the second tab extend through the body of the hang tag and into the third tab, which presses the protrusions against indentations of a third tab and bends the protrusions back into the hang tag to secure the tag holder to the hang tag, such that the hang tag may be used again for securing to a hanger rod. The tag holder may also be used to strengthen hang tags which are not damaged.

Although the preferred embodiment has been described in detail, it should be understood that various changes, substitutions and alterations can be made therein without departing from the spirit and scope of the invention as defined by the appended claims.

What is claimed is:

1. A tag holder comprising:

a first tab having an aperture defined therein for receiving a hanger, such that said tag holder is suspended from said hanger;

a second tab having at least one protuberance extending outwardly therefrom;

a third tab disposed adjacent to said second tab in a spaced apart position, in which said third tab is spaced apart from said second tab with said at least one protuberance spaced apart from said third tab and extending from said second tab toward said third tab;

a connecting portion extending between said second tab and said third tab, such that one of said second tab and said third tab is movable toward an other of said second tab and said third tab along said connecting portion, from said spaced apart position to a lock position, in which said at least one protuberance of said second tab extends into said third tab;

wherein said first tab, said second tab and said third tab are together configured for mounting a hang tag thereto, such that said aperture of said first tab is disposed adjacent to a hanger aperture of a hang tag, said connecting portion is disposed adjacent to an edge of the hanger aperture, said second tab and said third tab are disposed with a body of the hang tag located there-between, and movement of said one of said second tab and said third tab from said spaced apart position to said lock position moves said at least one protuberance through the body of the hang tag and into the third tab;

wherein said tag holder is formed as a single stamping of a material to define a singular body comprising said first tab, said second tab, and said third tab; and wherein said second tab is cut from a portion of said first tab to define said aperture in said first tab for receiving the hanger by which said tag holder is suspended, and then folded along said connecting portion to move from within said first tab to being disposed in said spaced apart position, adjacent said third tab.

2. The tag holder according to claim 1, wherein said at least one protuberance is defined by a protuberant lance portion formed into said second tab to extend outward of said second tab.

3. The tag holder according to claim 2, wherein said third tab has at least one indentation formed therein for receiving said at least one protuberance of said second tab and forming the at least one protuberance to bend toward the hang tag.

4. A tag holder comprising:

a singular body formed of a flat piece of material to define a first tab, a second tab, a third tab, and a connecting portion extending between said second tab and said third tab;

said first tab having an aperture defined therein for receiving a hanger;

said second tab having a protuberance extending outwardly therefrom;

said third tab disposed adjacent to said second tab in a spaced apart position, in which said third tab is spaced apart from said second tab with said at least one protuberance spaced apart from said third tab and extending from said second tab toward said third tab;

said connecting portion extending between said second tab and said third tab, said connecting being malleable for bending such that one of said second tab and said third tab is movable toward an other of said second tab and said third tab along said connecting portion from said spaced apart position to a lock position, in which said protuberance of said second tab extends into said third tab;

said first tab, said second tab and said third tab together configured for mounting a hang tag thereto, such that said aperture of said first tab is disposed adjacent to a hanger aperture of a hang tag, said connecting portion is disposed adjacent to an edge of the hanger aperture, said second tab and said third tab are disposed with a body of the hang tag located there-between, and movement of said one of said second tab and said third tab from said spaced apart position to said lock position moves said protuberance through the body of the hang tag and into the third tab;

wherein said third tab has at least one indentation formed therein for receiving said protuberance of said second tab and forming said protuberance to bend back toward the hang tag and;

wherein said second tab is cut from a portion of said first tab to define said aperture in said first tab for receiving the hanger by which said tag holder is suspended, and then folded along said connecting portion to move from within said first tab to being disposed in said spaced apart position, adjacent said third tab.

5. The tag holder according to claim 4, wherein said third tab is stationary with respect to said first tab, and said second tab is moved along said connecting portion relative to said first tab and said third tab.

6. The tag holder according to claim 4, wherein said protuberance is defined by a protuberant lance portion formed into said second tab to extend outward of said second tab.

7. The tag holder according to claim 4, wherein said protuberance is defined by a protuberant lance portion formed into said second tab to extend outward of said second tab.

8. The tag holder according to claim 7, wherein said third tab has at least one indentation formed therein for receiving said protuberance of said second tab and forming said protuberance to bend back toward the hang tag.

9. A method for providing a tag holder for securing to a hang tag, the method comprising the steps of:

providing a sheet of malleable material;

stamping a singular body from the sheet of malleable material to define a first tab, a second tab, a third tab, and a connecting portion extending between the second tab and the third tab, with the first tab having an aperture defined therein for receiving a hanger, and the second tab having a protuberance extending outwardly therefrom;

forming the singular body by bending the connecting portion to dispose the second tab and the third tab in a spaced apart relation, with the protuberance extending between the second tab and the third tab;

disposing the singular body adjacent a hang tag, with the aperture of the first tab located adjacent to a hanger aperture of the hang tag, the connecting portion located substantially adjacent to an edge of the hanger aperture, and a body of the hang tag located between the second tab and the third tab with the protuberance extending from the second tab toward the body of the hang tag; and then, further bending the connecting portion to move the one of the second tab and the third tab from the spaced apart relation to move the protuberance through the body of the hang tag and against the third tab.

10. The method according to claim 9, wherein the step of stamping comprises cutting the second tab from a portion of the first tab to define the aperture for receiving the hanger, and the step of forming by bending the connecting portion comprises moving the second tab from with the aperture of the first tab.

11. The method according to claim 10, wherein the third tab is stationary with respect to the first tab, and the second tab is moved toward the third tab by the step of bending the connecting portion.

12. The method according to claim 11, wherein the step of stamping defines the protuberance by lancing the sheet of material, and defines an indentation which is formed into the third tab in registration with the protuberance for receiving the protuberance in the step of further bending and bending the protuberance back toward the hang tag.

* * * * *